US007887678B2

(12) United States Patent
Yasuda et al.

(10) Patent No.: US 7,887,678 B2
(45) Date of Patent: Feb. 15, 2011

(54) ELECTRODE TOOL FOR ELECTROCHEMICAL MACHINING AND METHOD FOR MANUFACTURING SAME

(75) Inventors: Tomoyuki Yasuda, Nagano-ken (JP); Makoto Ide, Nagano-ken (JP)

(73) Assignee: Minebea Co., Ltd. (JP)

( * ) Notice: Subject to any disclaimer, the term of this patent is extended or adjusted under 35 U.S.C. 154(b) by 1246 days.

(21) Appl. No.: 10/586,372

(22) PCT Filed: Dec. 21, 2004

(86) PCT No.: PCT/US2004/042595

§ 371 (c)(1),
(2), (4) Date: Jul. 18, 2006

(87) PCT Pub. No.: WO2005/072098

PCT Pub. Date: Aug. 11, 2005

(65) Prior Publication Data

US 2007/0144917 A1 Jun. 28, 2007

(30) Foreign Application Priority Data

Jan. 23, 2004 (JP) ..... 2004-015934

(51) Int. Cl.
*B23H 3/00* (2006.01)

(52) U.S. Cl. ..... 204/224 M; 204/290.01; 29/825; 29/898.02; 29/561

(58) Field of Classification Search ..... 205/640; 204/224 M, 290.01
See application file for complete search history.

(56) References Cited

U.S. PATENT DOCUMENTS

| | | | |
|---|---|---|---|
| 6,638,414 | B2 | 10/2003 | MacLeod et al. |
| 2001/0027924 | A1 | 10/2001 | Kobayashi et al. |
| 2002/0126930 | A1 | 9/2002 | Obara |
| 2003/0221973 | A1 | 12/2003 | Heine et al. |

FOREIGN PATENT DOCUMENTS

| | | |
|---|---|---|
| JP | 2002-79425 | 3/2002 |
| JP | 3339792 | 10/2002 |
| JP | 2003-340648 | 12/2003 |

OTHER PUBLICATIONS

International Search Report issued on Oct. 10, 2006 for counterpart PCT application No. PCT/US04/42595.

*Primary Examiner*—Harry D Wilkins, III
*Assistant Examiner*—Zulmariam Mendez
(74) *Attorney, Agent, or Firm*—Kilpatrick Townsend & Stockton LLP

(57) ABSTRACT

An electrode tool for electrochemical machining includes a machining electrode surface (1*a*). The machining electrode surface (1*a*) includes a conductive pattern defined by lands (3) and grooves (3*a*) that are formed by groove machining the electrode surface (1*a*). The machining electrode surface (1*a*) is then molded with a hard insulating resin layer (4), and a surface of the hard insulating resin layer (4) is mechanically polished to expose the lands (3) of the conductive pattern. The lands (3) are chemically dissolved to obtain a conductive pattern (14) having a surface that is formed below a resulting insulating resin surface (2), with the height difference between the two surfaces being between 1 and 5 μm. The electrode tool allows precise surface machining of work pieces and can withstand prolonged use.

9 Claims, 5 Drawing Sheets

FIG. 1
PRIOR ART
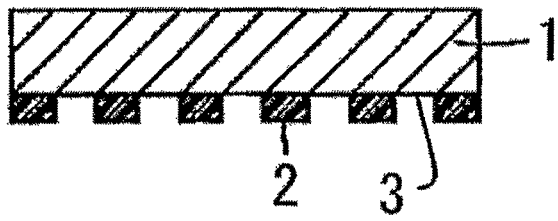
FIG. 2
PRIOR ART
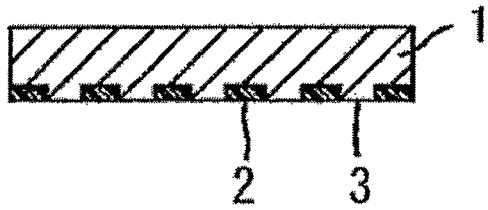
FIG. 3A
FIG. 3B
FIG. 3C
FIG. 3D
FIG. 3E
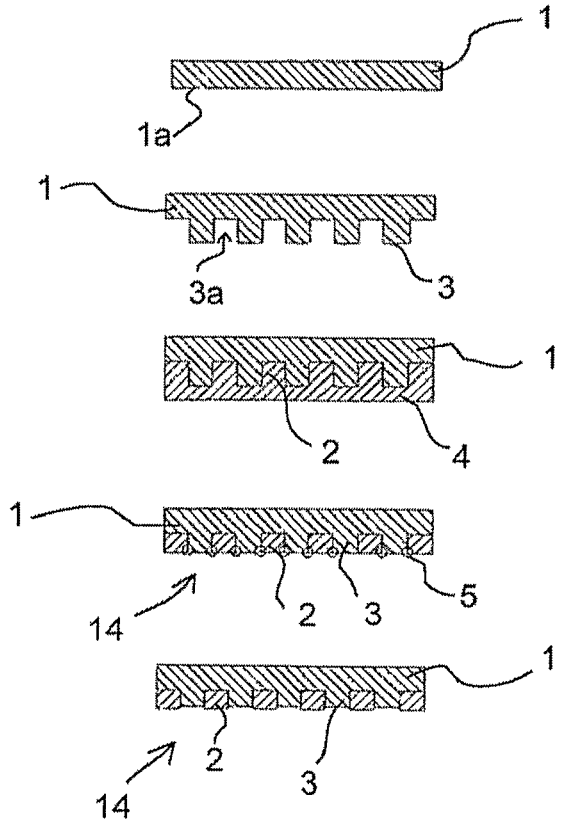

ELECTRODE TOOL FOR ELECTROCHEMICAL MACHINING AND METHOD FOR MANUFACTURING SAME

CROSS REFERENCE TO RELATED APPLICATION

This application is a 371 of PCT/US04/42595 filed on Dec. 21, 2004, and claims priority from Japanese Patent Application No. 2004-015934, which was filed on Jan. 23, 2004.

BACKGROUND OF THE INVENTION

The present invention relates to an electrode tool for electrochemical machining, and to a method of manufacturing the electrode tool. More specifically, the present invention relates to an electrode tool that is capable of performing electrochemical machining of dynamic pressure generating grooves in fluid bearings with a high degree of precision over long periods of time.

A dynamic groove machining device is utilized to form dynamic grooves on the surface of a work piece such as a fluid bearing. The dynamic grooves generate dynamic pressure on bearing fluid located between the bearing and a shaft to support the shaft within the bearing. As shown in FIG. 1, a conventional electrode tool for dynamic groove machining includes an electrode substrate 1 and a nonconductive insulating film 2 formed by a well known resist method on the surface of the electrode substrate 1. In this type of electrode tool, the finer the conductive pattern 3, the weaker the strength of adhesion between the electrode substrate 1 and the insulating film 2, and the higher the incidence of peeling of the insulating film 2.

The formed grooves correspond to an exposed pattern of conductive areas on the electrode tool. Another known type of electrode tool has a substrate covered in a region outside the aforementioned exposed pattern by an insulating resin layer. This insulating resin layer is formed by adhering and baking fine resin particles onto the substrate. Furthermore, another known dynamic groove machining device includes an electrode tool on which a resin sheet with holes preformed in the dynamic groove pattern to be machined is secured to the surface of the electrode substrate.

Moreover, in an electrode tool for electrochemical machining of fine surface shapes, since the insulating film of the regions outside the machining pattern is thin, the strength of adhesion of the nonconductive insulating resin to the substrate is typically weak. As a result, the insulating film tends to peel off due to the effects of the electrolyte solution used in the electrochemical machining process. This is because, in many cases, the nonconductive resin used for the insulating film is cured by ultraviolet rays, heat or the like, and its adhesion to the conductive substrate used in electrode tools is generally low.

In addition, since electrochemical machining of such fine surface shapes is performed with a narrow machining gap set between the electrode tool and the work piece, the insulating film is exposed to substantial shear forces from the flow of the electrolyte solution. When peeling of the insulating film occurs, it becomes impossible to accurately transfer the machining pattern to the work piece. Furthermore, the machining gap between the electrode tool and the work piece tends to clog with peeled off pieces of the insulating film. This clogging partially obstructs the flow of electrolyte solution, causing defects of the machined shapes in the work piece, and therefore lowering the yield of resulting products, such as dynamic bearings or the like, in which the work pieces are used as components. Moreover, the above-mentioned clogging can cause electrical shorts that damage both the electrode tool and the work piece.

To avoid the above-mentioned clogging problems, another known electrode tool for electrochemical machining is known in which an electrode includes a conductive area formed in a specific pattern on the surface of a conductive substrate. The electrode and a work piece, on the surface of which depressions are to be formed, are immersed facing one another into an electrolyte solution. The work piece and electrode are connected respectively to the positive pole and negative pole of a machining power supply, and current is passed through them to form depressions on the work piece surface corresponding to the conductive area pattern of the electrode. An electrodeposition coating film is formed as the insulating film on the regions of the surface of the electrode other than the aforementioned conductive area pattern.

As shown in FIG. 2, another type of known electrode tool has a conductive pattern with an electrode substrate surface defined by lands 3. The lands 3 are formed by groove machining the surface of the electrode substrate 1 and then molding the substrate 1 with insulating resin. The surface of the electrode substrate 1 is mechanically polished to expose the lands of the conductive pattern. The insulating film 2 is then filled into cut-away depressions in the substrate 1, the surface of which is substantially flat.

However, while there is little susceptibility to the effect of forces accompanying the flow of electrolyte solution in such an electrode tool configuration, the electrolyte solution gradually penetrates the boundary between the insulating film 2 and the conductive substrate 1, resulting in the insulating film 2 ultimately peeling off.

In yet a third type of known electrode tool for electrochemical machining, depressions are formed in those portions of the substrate of the electrode tool that face the work piece and that do not correspond to the dynamic groove pattern. Nonconductive insulating film is provided in the depressions, and the portions of the substrate not covered by the insulating film are formed into an exposed electrode pattern. The surface of the electrode pattern is formed so as to be flush with the surface of the nonconductive insulating film. Therefore, even if the machining gap is narrowed in order to improve transfer precision, there will be no retention of electrolytic byproducts generated by the machining or of heated electrolyte solution, and the desired electrolysis conditions can therefore be maintained. Furthermore, there is no clogging of peeled off pieces of nonconductive insulating film due to collision of electrolytic byproducts with the nonconductive insulating film 2, and drops in electrolyte solution flow rate are prevented.

When the above discussed surfaces on the electrode tool are made flush, concavities and convexities are eliminated, so drops in electrolyte solution flow rate are prevented to a greater extent. When such drops in flow rate are prevented, drops in current density are prevented as well, thereby reducing the surface roughness of the machined surfaces of the work piece. Furthermore, such prevention of drops in current density increases the electrochemical machining rate.

The above electrode tool can be formed with an electrode substrate surface having a conductive pattern defined by lands formed by groove machining. The electrode tool is molded with an insulating resin. The surface of the insulating resin is then mechanically polished to expose the lands of the conductive pattern. The electrode tool allows precise surface machining of work pieces and can withstand prolonged use.

However, it has been determined that when the above conductive pattern surface defined by lands is molded with the insulating resin, and the surface of the resin is mechanically polished, the lands tend to jut outwardly in the groove drop-off direction into an area that should be a trough when the polishing reaches the lands of the electrode substrate surface. This typically results in substantial burring because the electrode substrate, as compared to the insulating resin, has a ductility that is characteristic of metals.

SUMMARY OF THE INVENTION

In view of the above limitations of known electrode tools, an electrode tool of the present invention includes precisely formed grooves in a conductive pattern defined by lands, and in which the lands do not jut into the groove drop-off direction. More specifically, the electrode tool of the present invention includes lands and grooves formed by groove machining of the surface of an electrode substrate. The surface of the conductive pattern defined by the lands is formed below, or in other words recessed from, the surface of an insulating resin that is integrally molded over the conductive pattern and filled into the grooves. Specifically, the height difference between the two surfaces is between 1 and 5 μm.

By forming the conductive pattern surface of the electrode tool between 1 and 5 μm below the insulating resin surface, burring of the lands can be prevented. As a result, even with a fine conductive pattern, an electrode tool can be obtained that is capable of fabricating 200,000 or more work pieces with good reproducibility of the conductive pattern.

Furthermore, since burring of the electrode substrate and resin can be prevented, it becomes possible to accurately form fine land patterns. Moreover, by selecting an appropriate combination of substrate and resin, it is possible to fabricate electrode tools for electrochemical machining without burring.

The insulating resin used in the present invention can be of any type as long as it is a material with a high resistance to electrolyte solutions, as typified by, for example, $NaNO_3$ (sodium nitrate), and exhibits good adhesion to the electrode substrate. The insulating resin may be a material selected from among epoxy resin, urethane resin or polyimide resin. Moreover, the electrode substrate of the electrode tool of the present invention preferably includes copper alloys and iron alloys, with the copper alloys including brass, and the iron alloys including austenitic stainless steel.

Furthermore, another mode of the present invention relates to a method of manufacturing an electrode tool for electrochemical machining including creating a conductive pattern defined by lands provided by groove machining the electrode substrate surface, molding the electrode substrate surface with an insulating resin, mechanically polishing the surface of the insulating resin to expose the lands of the conductive pattern, and chemically dissolving the lands of the conductive pattern.

Moreover, in the present invention, when creating the conductive pattern defined by the lands, by rounding the edges of the lands where they drop off into grooves, it is possible to prevent the edges of the lands where they drop off into the grooves from expanding during polishing, thus preventing burring.

Electrochemical machining, milling or other mechanical machining, laser machining, electrical discharge machining, shot blasting or the like can be used for groove machining the electrode substrate and forming the depressions.

Moreover, the lands of the conductive pattern can be chemically dissolved by etching, by dissolving the electrode substrate with acid or alkali, or by electrochemical machining.

BRIEF DESCRIPTION OF THE DRAWINGS

The accompanying figures, in which like reference numerals refer to identical or functionally similar elements throughout the separate views and which, together with the detailed description below, are incorporated in and form part of the specification, serve to further illustrate various embodiments and to explain various principles and advantages all in accordance with the present invention.

FIG. 1 is a cross-section of a prior art electrode tool for electrochemical machining.

FIG. 2 is a cross-section of another prior art electrode tool for electrochemical machining.

FIGS. 3A-3E illustrate stages in a process for forming an electrode tool according to a first embodiment of the present invention.

DETAILED DESCRIPTION OF THE PREFERRED EMBODIMENTS

Figure 4A:
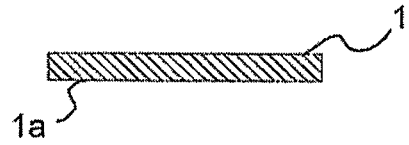
FIG. 4A-4E illustrate stages in a process for forming an electrode tool according to second and third embodiments of the present invention.

The present invention will now be described in detail in accordance with the drawings. Illustration and description of components are omitted where not necessary for one skilled in the art to understand the present invention.

Referring to FIGS. 3A-3E, a process for forming an electrode tool for electrochemical machining according to a first embodiment of the present invention will now be described.

In FIG. 3A, an electrode substrate 1, which is formed preferably from copper alloy brass, includes a surface 1*a* that is used as a machining electrode. The machining electrode surface 1*a* is washed, and, as shown in FIG. 3B, lands 3 are then milled on the surface 1*a* by groove machining. The lands 3 together form a conductive pattern, such as the conductive pattern 14 shown in FIG. 5. After the conductive pattern 14 is formed, the machining electrode surface 1*a* is degreased and washed.

Next, as shown in FIG. 3C, the top of the machining electrode surface 1*a* is molded with epoxy resin to form a hard insulating resin layer 4. The hard insulating resin layer 4 is polished by a polishing machine to gradually thin it until, as shown in FIG. 3D, the conductive pattern 14 becomes visible therethrough, with insulating resin 2 remaining in grooves 3*a* defined between the lands 3 after polishing. Burrs are formed at the edges 5 of the lands 3 where the lands 3 jut into the grooves 3*a*.

Next, the electrode tool is immersed for 3 seconds in a 60% nitric acid solution and washed with pure water. The conductive pattern 14 is etched, and the burrs are completely removed. As shown in FIG. 3E, a resulting electrode tool is formed, with the surface of the conductive pattern 14 being formed below, or in other words recessed from, the surface of the hard insulating resin layer 4. A height difference between the surface of the conductive pattern 14 and the surface of the insulating resin 2 is approximately 2 μm.

An electrode tool for electrochemical machining according to a second embodiment of the present invention may be fabricated by the process illustrated in FIGS. 4A-4E.

Figure 4B:
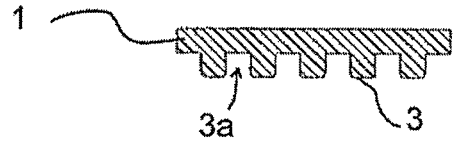

In the second embodiment, copper alloy brass is used as the electrode substrate 1. As shown in FIG. 4A, the surface 1*a* to be used as the machining electrode is washed. Next, as shown in FIG. 4B, lands 3 are milled on the surface 1*a* of the electrode substrate by groove machining to form the conductive pattern 14 shown in FIG. 5. After the conductive pattern 14 is formed, the edges of the lands 3 that jut into adjacent grooves 3*a* are rounded, and the surface 1*a* of the machining electrode is washed.

Figure 4C:
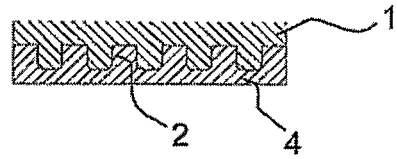
Figure 4D:
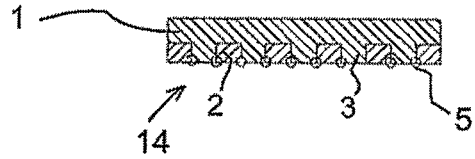

As shown in FIG. 4C, the surface 1*a* of the machining electrode is molded with epoxy resin to form a hard insulating resin layer 4 over the machining electrode. The hard insulating resin layer 4 is then removed by polishing, and an insulating resin 2 remains in the grooves after polishing. The hard insulating resin layer 4 is gradually thinned with a polishing machine until, as shown in FIG. 4D, the conductive pattern 14 is visible. Almost no burring occurs at the edges 5 of the lands 3 where edges 5 jut into the grooves 3*a*.

Figure 4E:
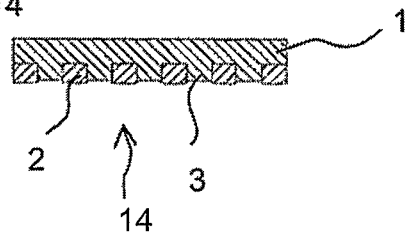

The electrode tool is then immersed for 2 seconds in a 60% nitric acid solution and washed with pure water. The conductive pattern 3 is then etched and the burrs are completely removed. Referring to FIG. 4E, the resulting electrode tool has a conductive pattern surface formed below, or recessed from, the surface of the insulating resin 2, with the height difference between the conductive pattern surface and the surface of the insulating resin 2 being approximately 3 μm.

An electrode tool for electrochemical machining according to a third embodiment of the present invention may also be fabricated by the process illustrated in FIGS. 4A-4E.

Specifically, an austenitic stainless steel SUS 304 is used as the electrode substrate 1. The surface to be used as the machining electrode is washed. As shown in FIG. 4B, groove machining of the surface of the machining electrode by laser machining is performed to form the lands 3. The lands 3 together form an electrode conductive pattern 14 such as that shown in FIG. 5.

After formation of the conductive pattern 14, the edges of the lands 3 that jut into the grooves 3*a* are rounded, and the machining surface is degreased and washed. As shown in FIG. 4C, the surface 1*a* of the machining electrode is molded with epoxy resin to form a hard insulating resin layer 4. The hard insulating resin layer 4 is polished and gradually thinned it until, as shown in FIG. 4D, the conductive pattern 14 becomes visible. Almost no burring occurs at the edges 5 of the lands 3 where the edges 5 jut into the grooves 3*a*.

Next, the electrode tool is immersed for 3 seconds in a 60% nitric acid solution and washed with pure water. The conductive pattern 14 is etched and any existing burrs are completely removed. The resulting electrode tool includes a conductive pattern 14, with a surface formed below the surface of the insulating resin 2, with a height difference between the conductive pattern surface and the surface of the insulating resin 2 being approximately 1 μm.

Electrode tools for electrochemical machining may also be fabricated in a manner similar to those discussed above in connection with the first, second and third embodiments based on the conditions shown in Table 1. Test results based on actual use of fourth through eighth embodiments, as well as comparative test results for a prior art electrode tool, are shown together with the corresponding fabrication conditions. The electrode tool of the prior art example was fabricated according to the above discussed first embodiment, except that the etching step was omitted.

TABLE 1

| Embodiment example | Electrode substrate | Insulating resin | Height difference (μm) | Rounding | Minimum Width (μm) | Life (10,000 pieces) |
|---|---|---|---|---|---|---|
| 1 | Brass | Epoxy | 2 | No | 25 | 20 or more |
| 2 | Brass | Epoxy | 3 | Yes | 20 | 20 or more |
| 3 | SUS 304 | Epoxy | 1 | Yes | 20 | 20 or more |
| 4 | Brass | Polyimide | 5 | No | 25 | 20 or more |
| 5 | SUS 304 | Epoxy | 3 | No | 20 | 25 or more |
| 6 | SUS 304 | Polyimide | 3 | No | 25 | 25 or more |
| 7 | SUS 303 | Epoxy | 2 | Yes | 20 | 25 or more |
| 8 | SUS 303 | Polyimide | 3 | No | 25 | 25 or more |
| Prior art example | Brass | Epoxy | 0 | No | 30 | 20 |

Figure 5:
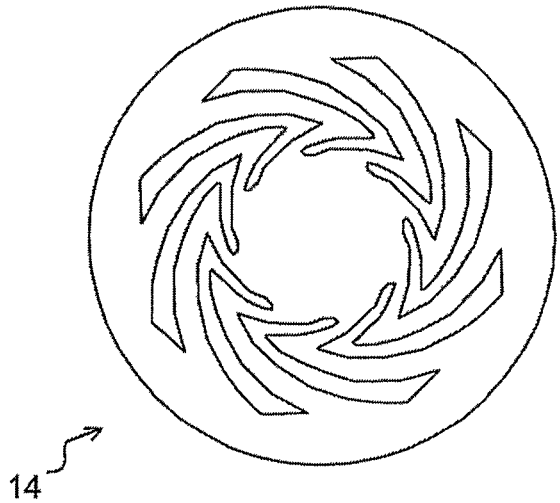
FIG. 5 is a schematic diagram of an exemplary conductive pattern of the type formed on an electrode tool according to the present invention.

In Table 1, the term "Minimum Width" refers to the minimum width of an electrode conductive pattern at the narrowest portions of the grooves (near the center of the pattern as can be seen in, for example, the exemplary electrode conductive pattern shown in FIG. 5) that can be accurately reproduced. In the present invention, this minimum width is approximately 20 μm±5 μm. Also, the term "Life" refers to the number of work pieces that a single electrode tool for electrochemical machining can manufacture while maintaining pattern reproducibility.

Figure 6:
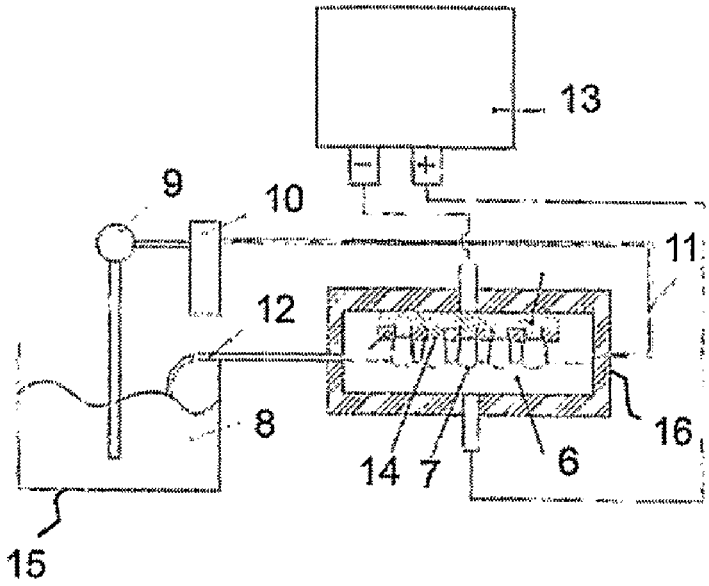
FIG. 6 is a diagram of an embodiment of an electrochemical machining unit in which an electrode tool according to the present invention is used.

An electrochemical machining unit for forming a conductive pattern on a work piece using an electrode tool of the type discussed in any one of the above discussed embodiments of the present invention is shown in FIG. 6.

The electrode tool, which includes the conductive pattern 14 formed from the electrode substrate 1 and insulating resin 2, and a work piece 6 are placed opposite each other across a gap (approximately 20 to 100 μm) through which the electrolyte solution 8 flows. The negative terminal of a direct current pulsed power supply 13 is connected to the electrode tool and the positive terminal is connected to the work piece 6.

A specific quantity of the electrolyte solution 8 containing 15 weight percent $NaNO_3$ (sodium nitrate) is stored in an electrolyte solution storage tank 15. An electrolyte solution feed pipe 11 that feeds the electrolyte solution 8 into the housing 16 of the electrode tool, and an electrolyte solution drain pipe 12 that drains the electrolyte solution from the housing 16 of the electrode tool and returns it to the electrolyte solution storage tank 15 are connected to the storage tank 15 across a pump 9 and a filter 10. The electrolyte solution 8 is therefore circulated through the housing 16 while being filtered by the filter 9.

Preferably, the flow rate of the electrolyte solution 8 in the electrochemical machining unit is set at 8 to 12 m/sec. Electrical current from the direct current pulsed power supply 13 at a voltage of 6 to 18 V is fed for 1 to 5 seconds to the electrode tool.

Figure 7:
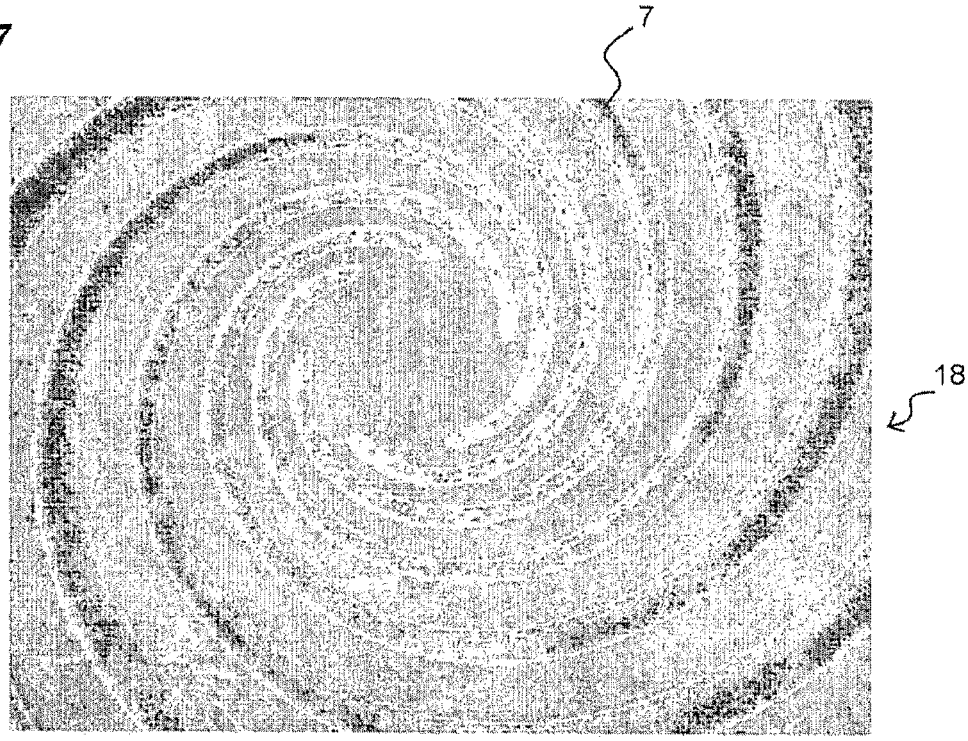
FIG. 7 is a photograph of an exemplary conductive pattern formed on a work piece by the electrochemical machining unit of FIG. 6.

Only the areas of the surface of the work piece 6 corresponding to the conductive pattern lands 3 of the electrode tool are removed and turned into grooves or depressions 7 by electrolysis action, whereby the grooves or depressions 7 are formed in the shape of the conductive pattern 14 of the electrode tool. FIG. 7 shows an exemplary conductive pattern 18 with grooves 7 formed on the work piece 6 by the above electrochemical machining unit.

Figure 8A:
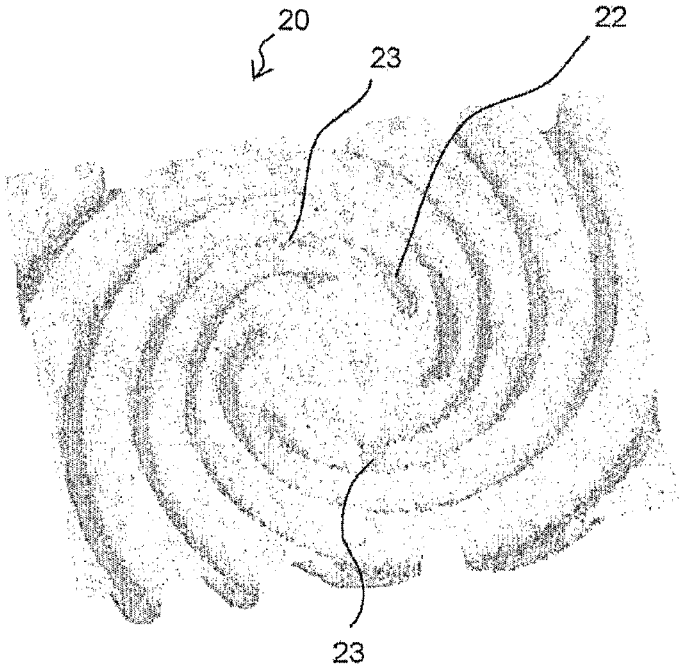
FIG. 8A PRIOR ART
FIG. 8A is a three dimensional picture generated by an optical interference measurement system that shows the conductive pattern formed on a work piece by the electrochemical machining unit of FIG. 6 with a conventional electrode tool.
Figure 8B:
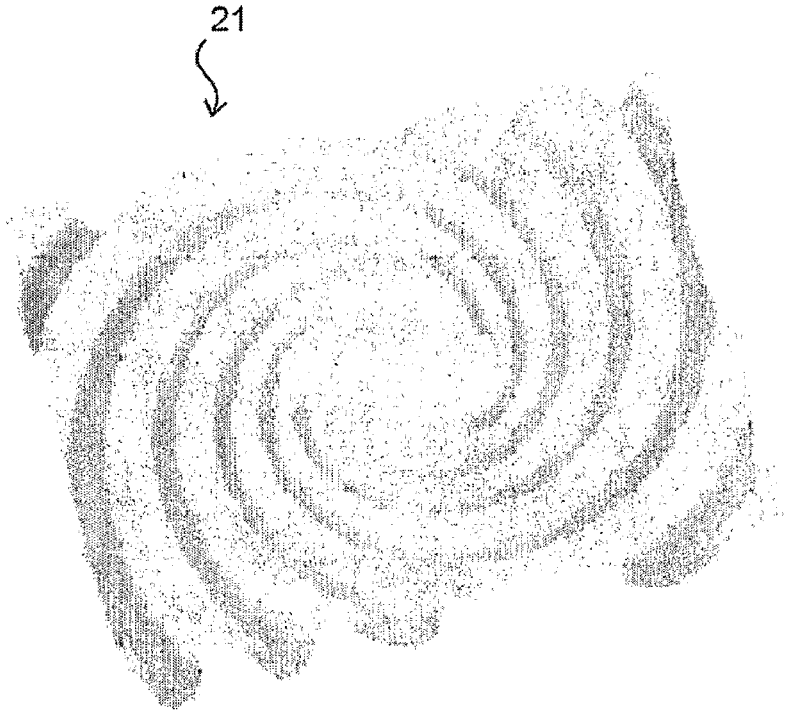
FIG. 8B is a picture generated by an optical interference measurement system that shows the conductive pattern formed on a work piece by the electrochemical machining unit of FIG. 6 with an electrode tool according to the present invention.

FIG. 8A is a three-dimensional picture generated by an optical interference measurement system that shows in more detail a conductive pattern 20 in an area of 1627 μm×1237 μm formed on a work piece surface by the electrochemical machining unit of FIG. 6 with a conventional electrode tool of the type such as that previously discussed. FIG. 8B is a picture generated by an optical interference measurement system that shows in more detail a conductive pattern 21 in an area of 1627 μm×1234 μm formed on a work piece surface by the electrochemical machining unit of FIG. 6 with an electrode tool of the present invention. As shown, the conductive pattern 20 exhibits deformations, such as the deformation shown at 22, at tips, or end portions, of the grooves that result in groove separation breaks, such as the groove separation breaks shown at 23. On the other hand, the conductive pattern 21 is free of such deformations or groove separation breaks, as the electrode tool according to the present invention can form dynamic grooves of higher precision and without defects, thereby resulting in, for example, fluid bearings that exhibit better performance than fluid bearings having dynamic grooves formed by conventional electrode tools.

The electrode tool of the present invention can be formed without associated burring on the surface of the machining electrode, thus allowing a land conductive pattern that is not affected by burrs to be accurately formed. Furthermore, the above described manufacturing methods for the electrode tool of the present invention make it possible to prevent burring even with electrode substrates and resins that are prone to burring. This makes it possible to select combinations of electrode substrate and resin to fabricate electrode tools with the desired characteristics, which in turn contributes to the development of smaller fluid bearings.

The disclosure is intended to explain how to fashion and use various embodiments in accordance with the invention and is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and modifications as are suited to the particular use contemplated, and which fall within the scope of the invention as determined by the appended claims, and all equivalents thereof, when interpreted in accordance with the breadth to which they are fairly, legally, and equitably entitled.

The invention claimed is:

1. An electrode tool for electrochemical machining comprising:

an electrode substrate including a machining electrode surface;

a conductive pattern defined by a plurality of lands and grooves formed on the machining electrode surface;

an insulating resin molded integrally with the electrode substrate and filled into the grooves of the conductive pattern, wherein the lands define a surface of the conductive pattern that is recessed from a surface of the insulating resin filled into the grooves of the conductive pattern, and a height difference between the surface of the conductive pattern and the surface of the insulating resin is between 1 and 5 μm.

2. The electrode tool as set forth in claim 1, wherein the insulating resin comprises a resin selected from among epoxy resin, urethane resin and polyimide resin.

3. The electrode tool as set forth in claim 1, wherein the electrode substrate comprises one of brass and austenitic stainless steel, and the insulation layer comprises an epoxy resin.

4. The electrode tool as set forth in claim 1, wherein the lands comprise deburred lands.

5. The electrode tool as set forth in claim 1, wherein the height difference between the surface of the conductive pattern and the surface of the insulating resin is between 1 and 3 μm.

6. The electrode tool as set forth in claim 1, wherein the height difference between the surface of the conductive pattern and the surface of the insulating resin is 2 μm.

7. The electrode tool as set forth in claim 1, wherein the height difference between the surface of the conductive pattern and the surface of the insulating resin is 3 μm.

8. The electrode tool as set forth in claim 1, wherein the lands have rounded edges.

9. The electrode tool as set forth in claim 1, wherein the conductive pattern reproduced on a work piece is free of groove separation breaks.

* * * * *